US010538950B2

(12) United States Patent
Collene

(10) Patent No.: US 10,538,950 B2
(45) Date of Patent: Jan. 21, 2020

(54) LID HINGE ASSEMBLY WITH SNUBBER AND COUNTERBALANCE SPRING

(71) Applicant: Mansfield Engineered Components, Inc., Mansfield, OH (US)

(72) Inventor: James Collene, Bucyrus, OH (US)

(73) Assignee: Mansfield Engineered Components, Inc., Mansfield, OH (US)

( * ) Notice: Subject to any disclaimer, the term of this patent is extended or adjusted under 35 U.S.C. 154(b) by 0 days.

(21) Appl. No.: 15/344,215

(22) Filed: Nov. 4, 2016

(65) Prior Publication Data

US 2017/0130502 A1 May 11, 2017

Related U.S. Application Data

(60) Provisional application No. 62/251,421, filed on Nov. 5, 2015.

(51) Int. Cl.
*E05F 3/20* (2006.01)
*E05D 7/00* (2006.01)
(Continued)

(52) U.S. Cl.
CPC ..... *E05F 3/20* (2013.01); *D06F 37/28* (2013.01); *D06F 58/20* (2013.01); *E05D 7/00* (2013.01);
(Continued)

(58) Field of Classification Search
CPC ..... E05F 3/20; E05F 3/10; E05F 3/18; E05F 1/1276; E05F 1/1269; E05F 1/1058;
(Continued)

(56) References Cited

U.S. PATENT DOCUMENTS 3,256,554 A 6/1966 Turner
3,737,947 A 6/1973 Little
(Continued)

OTHER PUBLICATIONS

Letter regarding Co-Pending U.S. Appl. No. 15/342,830, filed Nov. 3, 2016.

*Primary Examiner* — Daniel J Troy
*Assistant Examiner* — Timothy M Ayres
(74) *Attorney, Agent, or Firm* — Fay Sharpe LLP

(57) ABSTRACT

A hinge assembly for pivotally connecting an associated appliance lid to an associated appliance body includes a base adapted to be connected to the associated appliance body. The hinge assembly also includes a snubber housing connected to the base. A cam is rotatably supported on the snubber housing, and the cam is adapted to be engaged by the associated appliance lid and rotate about a lid pivot axis in a first direction and in a second direction that is opposite the first direction. A snubber is operatively connected to the snubber housing. The cam exerts a snubber activation force on the snubber when the cam rotates about the lid pivot axis in the second direction corresponding to movement of the associated appliance lid from an opened position toward a closed position and such that the snubber damps movement of the cam when the cam rotates in the second direction. A counterbalance spring is operatively engaged between the base and the cam and exerts a counterbalance force on the cam that biases the cam in the first direction.

7 Claims, 9 Drawing Sheets

(51) Int. Cl.
*E05F 3/18* (2006.01)
*E05F 3/10* (2006.01)
*D06F 37/28* (2006.01)
*D06F 58/20* (2006.01)

(52) U.S. Cl.
CPC ..... *E05F 3/10* (2013.01); *E05F 3/18* (2013.01); *E05Y 2900/312* (2013.01)

(58) Field of Classification Search
CPC ..... E05F 1/105; D06F 37/28; D06F 58/20; E05D 7/00; E05Y 2900/312
USPC ..... 312/319.2
See application file for complete search history.

(56) References Cited

U.S. PATENT DOCUMENTS 4,947,516 A * 8/1990 Kretchman ..... D06F 39/14 16/289
5,269,043 A 12/1993 Yang
6,415,477 B1 * 7/2002 Hosaka ..... E05F 1/1261 16/284
6,679,572 B2 * 1/2004 Sears ..... D06F 39/14 312/319.2
6,766,563 B2 * 7/2004 Lee ..... A23B 7/0425 16/281
6,845,545 B2 * 1/2005 Han ..... E05F 1/1269 16/277
7,243,396 B2 7/2007 Vanini
7,552,509 B2 * 6/2009 Chen ..... E05F 5/006 16/286
7,676,888 B2 * 3/2010 Vanini ..... E05F 1/1261 16/277
7,861,371 B2 * 1/2011 Kim ..... E05F 5/10 16/52
7,937,807 B2 * 5/2011 Bereznai ..... E05F 5/10 16/82
8,096,455 B2 1/2012 Viklund et al.
8,250,706 B2 8/2012 Vanini
8,443,489 B2 5/2013 Sir Louis
8,991,010 B2 3/2015 Brunnmayr
9,080,365 B2 * 7/2015 Collene ..... E05F 1/1261
9,121,211 B1 * 9/2015 White ..... E05F 3/20
9,169,681 B2 10/2015 Cooper et al.
9,181,741 B2 11/2015 Bettinzoli
9,394,645 B2 * 7/2016 Park ..... D06F 39/14
2006/0053589 A1 3/2006 Vanini
2007/0251052 A1 * 11/2007 Pyo ..... E05F 5/02 16/86 A
2009/0064458 A1 3/2009 Vanini
2010/0281650 A1 * 11/2010 Kleemann ..... A47L 15/4261 16/64
2011/0094056 A1 * 4/2011 Lautenschlager ..... E05F 5/02 16/84
2011/0298349 A1 12/2011 Sutterlutti
2013/0239364 A1 9/2013 Sir Louis
2014/0345082 A1 * 11/2014 Collene ..... E05F 1/1058 16/58
2015/0354261 A1 * 12/2015 Dora ..... F24C 15/023 49/31
2017/0030125 A1 * 2/2017 Bacchetti ..... E05F 3/10
2017/0122020 A1 * 5/2017 Collene ..... E05F 3/20
2017/0254133 A1 * 9/2017 Liang ..... E05D 5/065
2018/0010377 A1 * 1/2018 Bacchetti ..... E05F 3/10

* cited by examiner

LID HINGE ASSEMBLY WITH SNUBBER AND COUNTERBALANCE SPRING

CROSS-REFERENCE TO RELATED APPLICATION

This application claims priority from and benefit of the filing date of U.S. provisional application Ser. No. 62/251,421 filed Nov. 5, 2015, and the entire disclosure of said provisional application is hereby expressly incorporated by reference into the present specification.

BACKGROUND

Top-loading appliances such as clothes washing and drying machines include a lid that pivots about a horizontal pivot axis between an opened and a closed position. When pivoted upward to the opened position, the lid is moved away from and provides access to a chamber for washing or drying clothes or for another purpose that varies depending upon the function of the appliance. When pivoted downward to the closed position, the lid is moved into abutment with the appliance body and covers an open mouth or entrance of the chamber in order for the appliance to function properly, quietly, safely, and efficiently. Because movement of the lid from its opened position to its closed position is associated with pivoting movement of the lid downward as aided by gravity, it has been deemed desirable to prevent harsh closing or "slamming" of the lid as it closes. As such, a need has been identified for a lid hinge assembly for a top-loading appliance that dampens or cushions movement of the lid as it moves to its closed position but that also fits within a small envelope, is self-contained so as to be easily installed or replaced, is cost-effective, and that is sufficiently durable to withstand heavy use over many years in a damp environment of variable temperature.

Another drawback associated with known damping systems for top-loading appliances is that the damping mechanism prevents the lid from completely and tightly closing and abutting the appliance body when the lid is moved to its closed position, which has undesired effects on aesthetics, safety, noise, and overall operation of the appliance. For example, if the appliance control system senses that the lid is opened, the control system will sometimes interrupt the clothes washing, drying, or other operation being performed as a safety feature. As such, a need has been identified for a damping system for the lid of a top-loading appliance that provides effective damping without inhibiting complete closing of the lid.

It has also been deemed desirable to provide a counterbalance feature for the lid hinge of a top-loading appliance. More particularly, it has been desired in certain applications to provide a counterbalance force that reduces the manual force required for a user to pivot the lid from its closed position toward its opened position, and to provide a counterbalance force that counteracts the gravitational force exerted on the lid as the lid pivots from an opened position toward its closed position.

SUMMARY

In accordance with a first aspect of the present development, a hinge assembly for pivotally connecting an associated appliance lid to an associated appliance body includes a base adapted to be connected to the associated appliance body. The hinge assembly also includes a snubber housing connected to the base. A cam is rotatably supported on the snubber housing, and the cam is adapted to be engaged by the associated appliance lid and rotate about a lid pivot axis in a first direction and in a second direction that is opposite the first direction. A snubber is operatively connected to the snubber housing. The cam exerts a snubber activation force on the snubber when the cam rotates about the lid pivot axis in the second direction corresponding to movement of the associated appliance lid from an opened position toward a closed position and such that the snubber damps movement of the cam when the cam rotates in the second direction. A counterbalance spring is operatively engaged between the base and the cam and exerts a counterbalance force on the cam that biases the cam in the first direction.

In accordance with another aspect of the present development, an appliance includes a body with a chamber with an open mouth. A lid selectively covers the open mouth of the chamber. A hinge assembly pivotally connects the lid to the body. The hinge assembly includes a base connected to the appliance body and a snubber housing connected to the base. A cam is rotatably supported on the snubber housing, and the cam is adapted to be engaged by the appliance lid and rotate about a lid pivot axis in a first direction and in a second direction that is opposite the first direction. A snubber is operatively connected to the snubber housing. The cam exerts a snubber activation force on the snubber when the cam rotates about the lid pivot axis in the second direction corresponding to movement of the appliance lid from an opened position toward a closed position and such that the snubber damps movement of the cam when the cam rotates in the second direction. A counterbalance spring is operatively engaged between the base and the cam and exerts a counterbalance force on the cam that biases the cam in the first direction.

DETAILED DESCRIPTION

Figure 1:
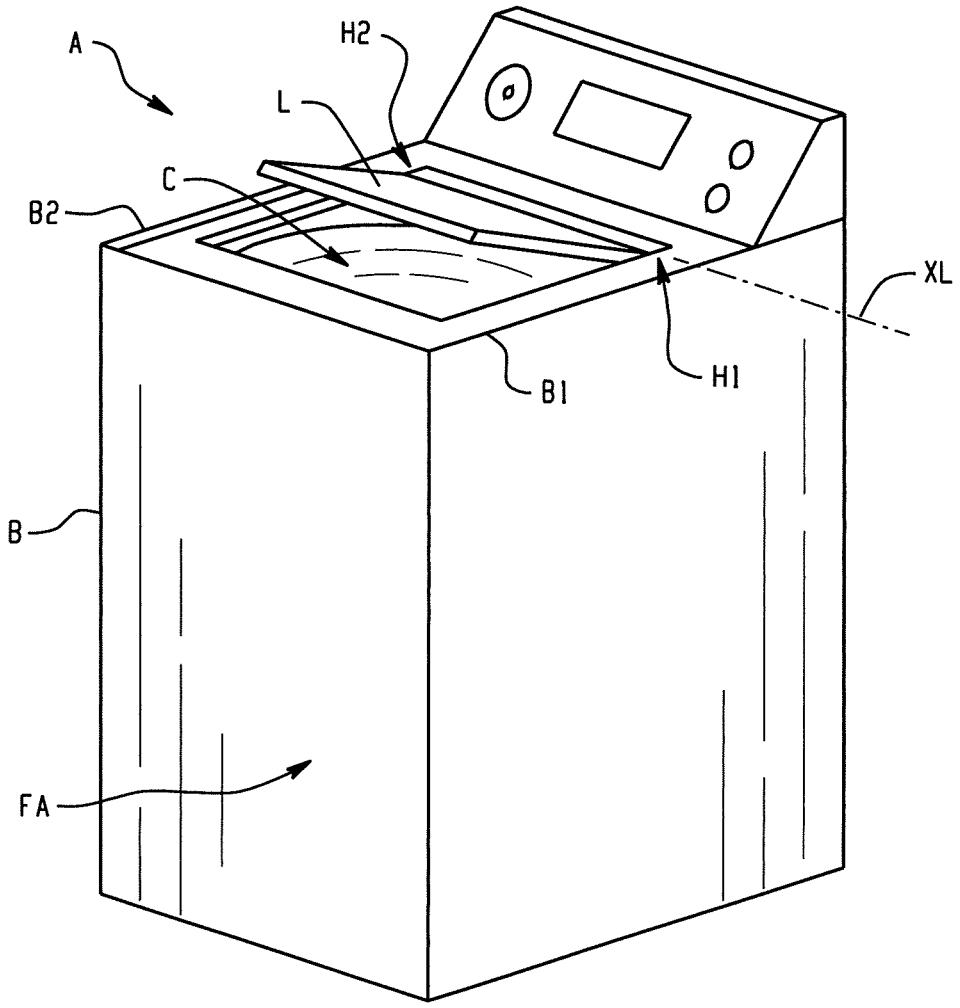
FIG. 1 is an isometric view of a top-loading appliance such as a clothes washing machine including a lid that is pivotally connected to a body by at least one lid hinge assembly provided in accordance with the present development.

FIG. 1 shows a top-loading appliance A such as a clothes washing machine or dryer. The appliance A includes a body B and a lid L that is pivotally connected to the body B and adapted for pivoting movement relative to the body about a horizontal lid pivot axis XL between a closed position, where the lid L covers or blocks access to a chamber C located inside the body, and an opened position, in which the lid L is moved to a position where it uncovers or opens and allows access to the chamber C. FIG. 1 shows the lid L in a partially opened position located between the closed position (also referred to as the fully closed position) and an opened position (also referred to as the fully opened position). Typically, the fully opened position of the lid is at least or slightly greater than 90 degrees away from the closed position.

The lid L is operatively secured to the body B for such pivoting movement by a first hinge or hinge assembly H1 located adjacent a first lateral side of the lid L/body B and a second hinge or hinge assembly H2 located adjacent a second lateral side of the lid L/body B (the hinge assemblies H1,H2 are sometimes generally referred to herein as hinge assemblies H). Either one or both of the hinge assemblies H1,H2 are provided in accordance with the present development as described herein.

Figure 2:
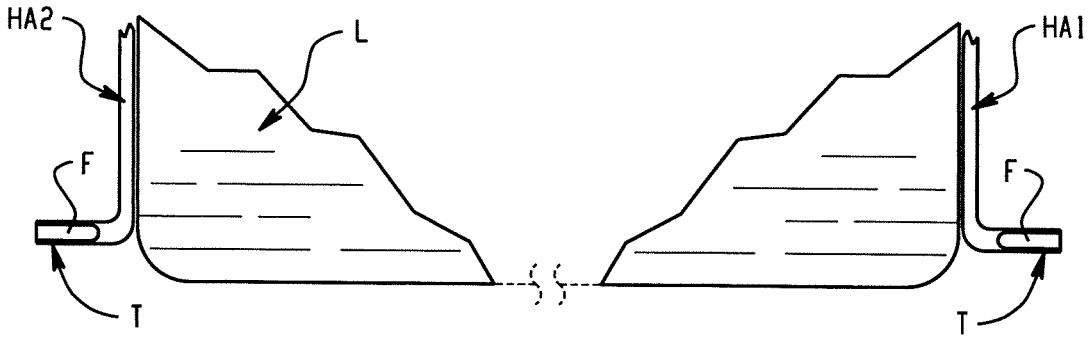
FIG. 2 is a partial view of the lid of the appliance of FIG. 1 by itself and shows that the lid includes first and second hinge arms connected respectively to opposite first and second lateral sides of the lid.

FIG. 2 shows the lid by itself, and it can be seen that first and second hinge arms HA1,HA2 are connected respectively to opposite first and second lateral sides of the lid L, respectively. Each hinge arm HA1,HA2 comprises a metal wire form or like structure secured to or otherwise provided as part of the lid L and comprising a tip T that projects transversely outward away from the lid. Each tip T includes one or more flats F or is otherwise defined with a non-circular cross-section for non-rotatable engagement with the respective mating hinge assembly H1,H2 connected to the appliance body B as described below for pivotally securing the lid L to the body B. The hinge arms HA1,HA2 can have other structures or be defined from other materials, e.g., the hinge arms can be provided by a metal or molded polymeric stud connected to or provided as part of the lid L and projecting outwardly therefrom. Each hinge assembly H can alternatively be referred to as a motion control assembly, in which case the hinge arms HA1,HA2 can each be referred to as a hinge that engages the motion control assembly H.

Figure 3A:
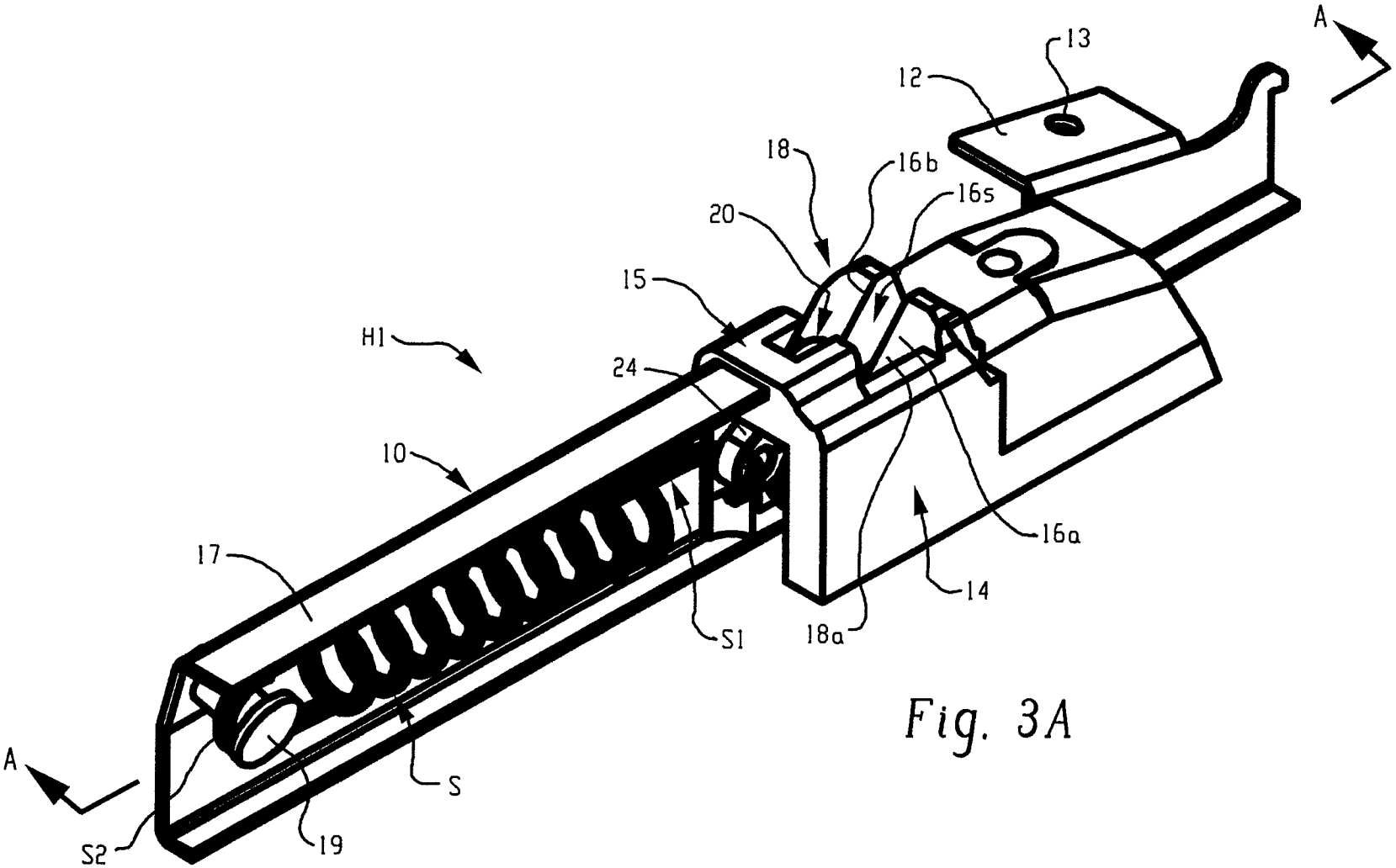
FIG. 3A is a front isometric view of a hinge assembly with a snubber and counterbalance spring in accordance with an embodiment of the present development.
Figure 3B:
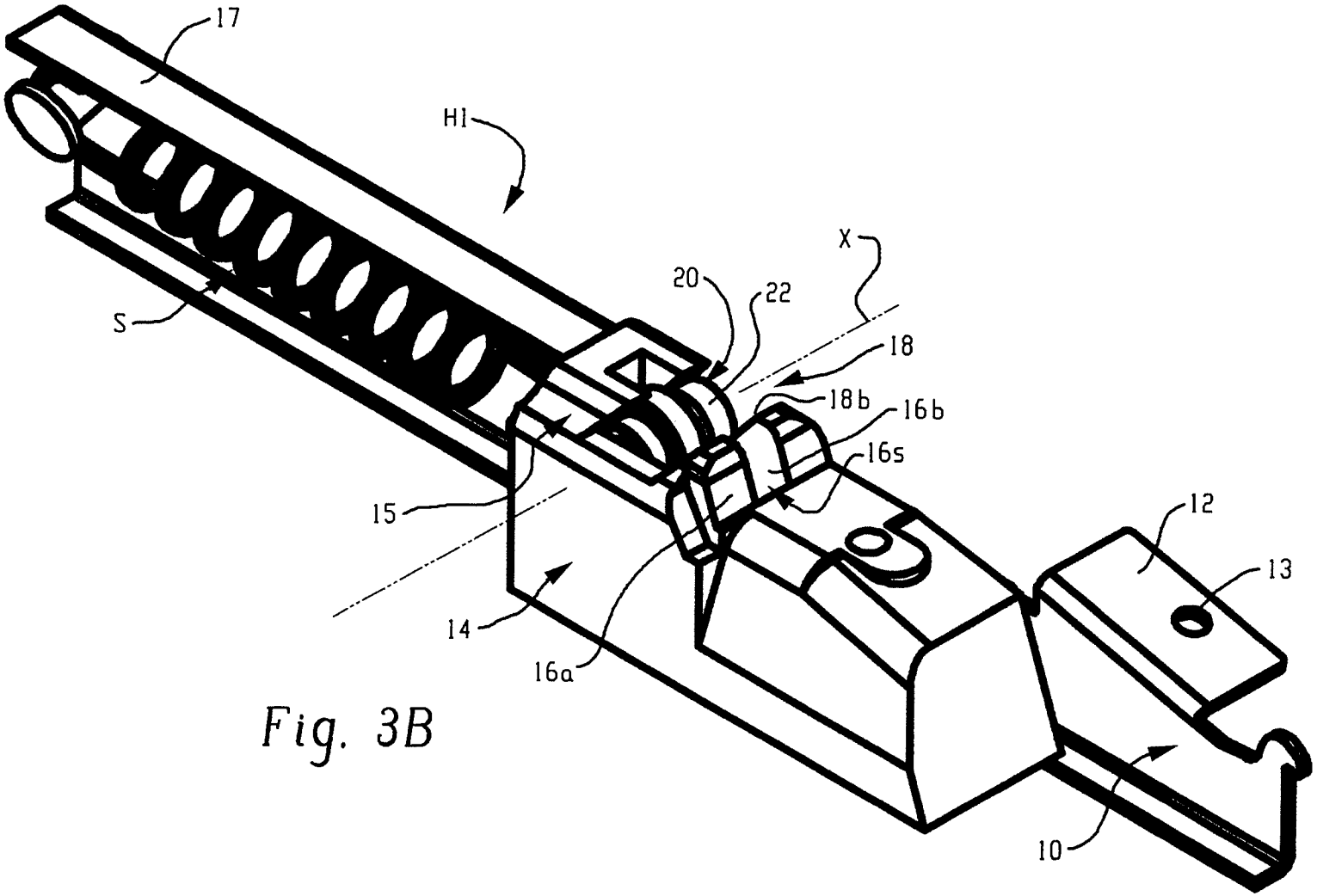
FIG. 3B is a rear isometric view of the hinge assembly of FIG. 3A.

FIGS. 3A & 3B respectively provide front and rear isometric views of a first hinge assembly H1 provided in accordance with the present development. In one embodiment, the second hinge assembly H2 is constructed as a mirror image of the illustrated first hinge assembly H1. Alternatively, the illustrated hinge assembly H1 can be made ambidextrous so that it can be installed adjacent either the first lateral side B1 of the body B or chamber C or the second lateral side B2 of the body B or chamber C and function as either the first hinge assembly H1 or the second hinge assembly H2, respectively. To simplify the present description, the present development is described with reference to the illustrated first hinge assembly H1, but those of ordinary skill in the art will recognize that the second hinge assembly H2 can have a corresponding structure that is a mirror image of the first hinge assembly H1 or that otherwise corresponds to the first hinge assembly H1.

The hinge assembly H1 comprises a channel or base 10 preferably defined as a unitary or one-piece stamped metal structure including a mounting flange 12 comprising one or more apertures 13 that receive a rivet, screw or like fastener for operatively securing the base 10 to the appliance body B. Alternatively, the base 10 is a polymeric structure and/or is assembled from multiple pieces of metal and/or polymeric material.

The hinge assembly H1 further comprises a housing or snubber housing 14 that is connected to the base 10. For example, the snubber housing 14 is connected to the base 10 by being defined as a one-piece construction with the base 10, or is a separate component that is connected to the base 10. As shown, the housing 14 comprises a one-piece polymeric structure that is connected to the base 10 using fasteners and/or a snap-fit, friction-fit, and/or by other suitable means. Base 10 and housing 14 can be provided together as one-piece or multi-piece polymeric, metal and/or other structure.

An outer or upper portion 15 of the housing 14 comprises a notch or other recess 18, and the hinge assembly H further comprises a cam 20 located in the notch 18 and adapted for rotation in first and second opposite directions FA1,FA2 about an axis of rotation X coincident with or corresponding to the lid pivot axis XL, with the first direction FA1 corresponding to movement of the lid L from its closed position toward its opened position, and the second direction FA2 corresponding to movement of the lid L from its opened position toward its opened position. More particularly, the upper portion 15 of the housing 14 comprises first and second parallel, spaced-apart support walls 16*a*,16*b* that define a space or slot 16*s* there between. The walls 16*a*,16*b* include respective notches or recesses 18*a*,18*b* that are aligned or registered with each other to provide or define the notch/recess 18 in which the cam 20 is received and rotatably supported. In an alternative embodiment, one or both of the notches or recesses 18*a*,18*b* are provided by or comprise a hole or aperture with an enclosed perimeter and in which the opposite ends of the cam are respectively supported for rotation relative to the housing 14.

The cam 20 comprises a camshaft 22 having its opposite ends respectively supported for rotation in the notches 18*a*,18*b*, and the cam 20 further comprises a cam lobe, ear, tab, or other projection 24 that extends or projects radially outwardly from the camshaft 22 between its opposite ends. The cam lobe 24 is located in the space 16*s* defined between the support walls 16*a*,16*b* for at least certain angular positions of the cam 20. The camshaft 22 rotates in the recess 18 relative to the housing 14 about the axis of rotation X which corresponds to the pivot axis XL of the appliance lid L.

At least one or both opposite ends of the camshaft 22 are adapted to be connected to one of the lid hinge arms HA1,HA2 such that the hinge arm HA1,HA2 and the camshaft 22 rotate together about the axis of rotation X when connected. In the illustrated embodiment, at least an inwardly facing end and optionally both of the opposite ends of the camshaft 22 include respective non-circular apertures or recesses 23 (see FIGS. 4A-4C) that non-rotatably receive and mate with the tip T of an associated hinge arm HA1, HA2 in a non-rotatable or keyed manner, but other mating connections between a hinge arm HA1,HA2 and the camshaft 22 can be used. When the tip T of an appliance lid hinge arm HA1,HA2 is mated with one of the cam apertures 23, the cam 20 rotates in response to pivoting movement of the lid L between its opened and closed positions. In an alternative embodiment, the cam 20 is provided as part of a hinge arm HA1,HA2, for example the cam 20 is provided as a one-piece construction with or otherwise connected to the remainder of the hinge arm HA1,HA2, in which case the lid L is connected directly to the hinge assembly H when secured to the hinge arm HA1,HA2 by one or more fasteners, welding, and/or otherwise.

Figure 4A:
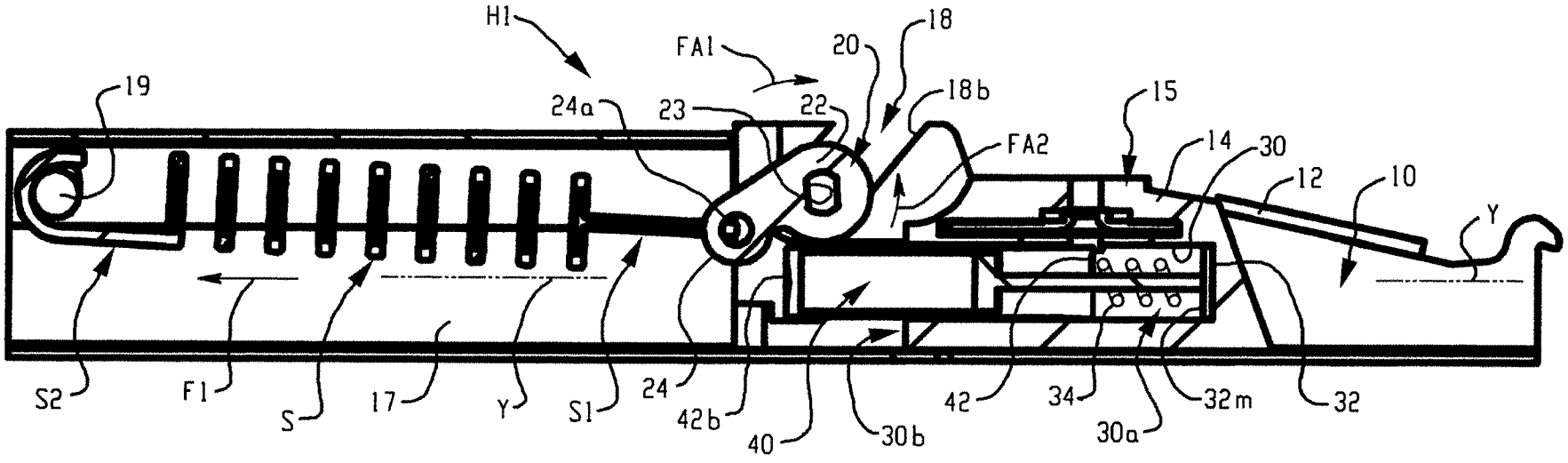
FIG. 4A is a section view of the hinge assembly as taken at line A-A of FIG. 3A, showing the hinge assembly in a first operative position corresponding to a fully opened position for the lid of the appliance.
Figure 4B:
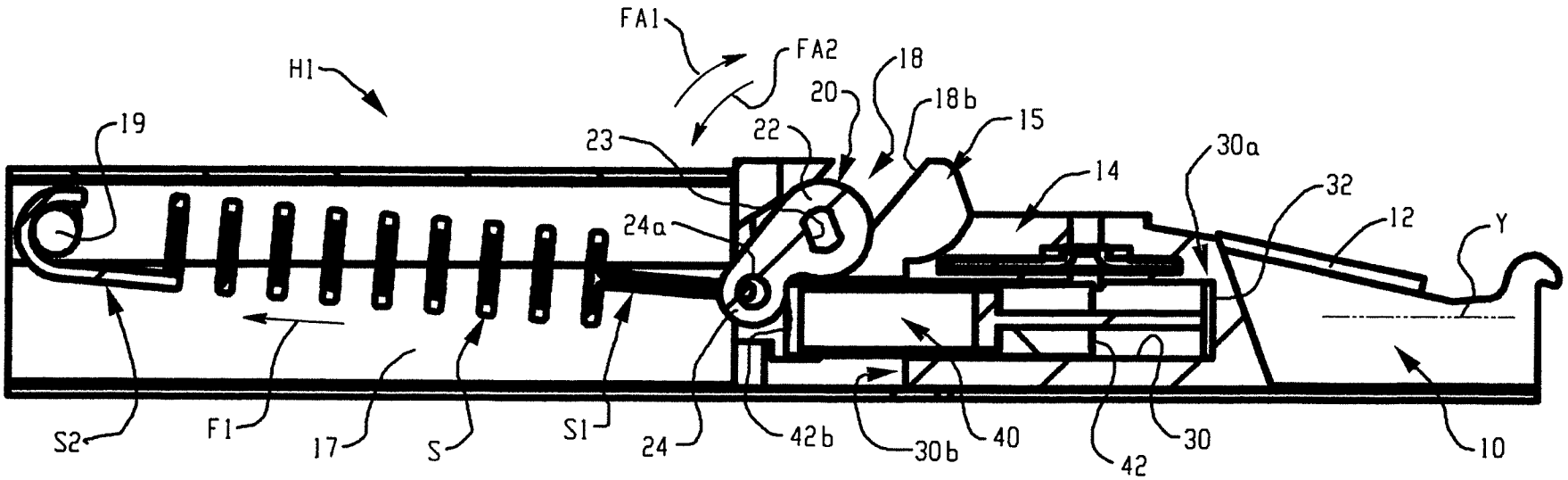
FIG. 4B is a section view of the hinge assembly that is similar to FIG. 4A but shows the hinge assembly in an intermediate operative position corresponding to the lid of the appliance being located between the opened and closed positions, i.e., partially opened or partially closed.
Figure 4C:
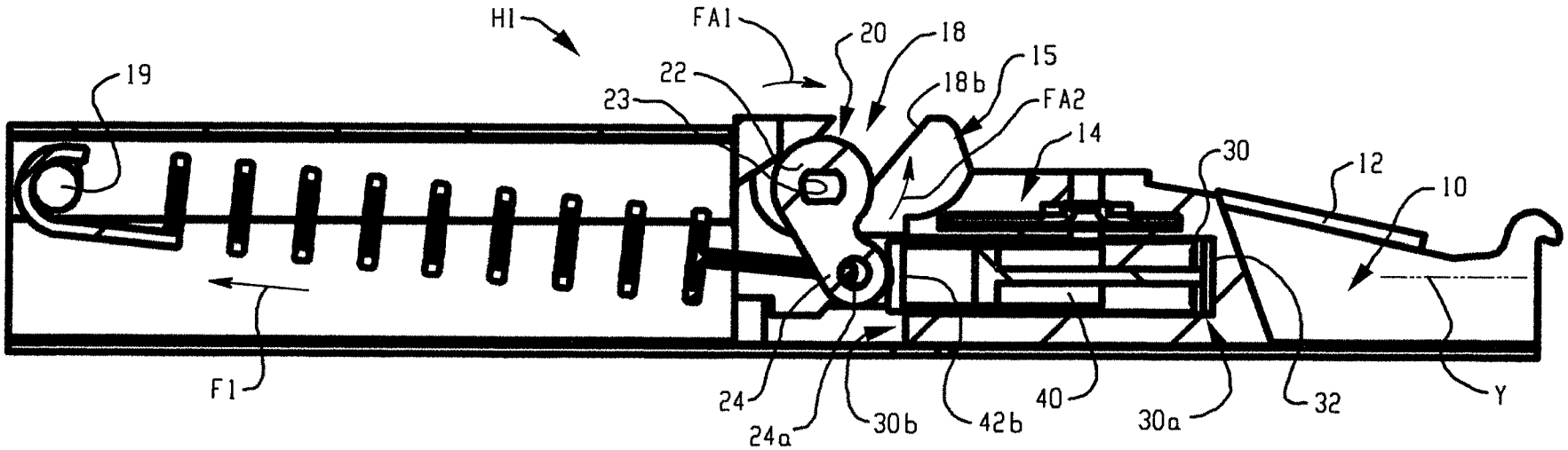
FIG. 4C is a section view of the hinge assembly that is similar to FIGS. 4A and 4B but showing the hinge assembly in a second operative position corresponding to a fully closed position for the lid of the appliance.

FIG. 4A is a cross-section of the hinge assembly H1 as taken at line A-A of FIG. 3A that shows the hinge assembly H1 in a first position corresponding to a fully opened position of the appliance lid L. FIG. 4C is similar to FIG. 4A but shows the hinge assembly H1 in a second position where the cam 20 has been rotated to a position corresponding to the appliance lid L being fully closed. FIG. 4B is similar to FIGS. 4A and 4C but shows the hinge assembly H1 in an intermediate position where the cam 20 has been rotated to a position corresponding to the appliance lid L being partially opened or partially closed, i.e., the lid L is located partially between its fully opened and fully closed positions. Comparing FIGS. 4A-4C, it can be seen that rotation of the cam 20 causes the cam lobe 24 to move on an arc in first and second opposite angular directions FA1,FA2 about the axis of rotation X to and between a first angular position (FIG. 4A), an intermediate angular position (FIG. 4B), and a second angular position (FIG. 4C).

The base 10 comprises a projection or tail 17 that extends outwardly away from a forward end of the housing 14 that is oriented toward the front FA of the appliance A. A counterbalance spring S is operably connected between the cam 20 and the tail 17, and the spring S biases the cam 20 in the first direction FA1 toward the first angular position corresponding to the fully opened position of the appliance lid L. The cam 20 is selectively rotatable in the second direction FA2 about the axis of rotation X against the biasing force exerted on the cam 20 by the spring S toward and to a second position corresponding to the closed position of the appliance lid L. More particularly, in the illustrated embodiment, a first end S1 of the spring S is operatively connected to the cam lobe 24, and this connection is made by a notch or aperture 24*a* defined in the cam lobe 24 that is directly engaged by a hook or loop defined in the first end S1 of the spring, or another type of direct connection or indirect connection (e.g., through a linkage or the like) can be made between the first spring end S1 and the cam lobe 24. The second end S2 of the spring S is connected to the tail 17 of the base at an anchor location or anchor 19 spaced from the cam 20. As shown herein, the base 10 comprises an anchor 19 provided by a rivet connected to the tail 17, but the anchor or anchor location 19 can alternatively be provided by a notch or aperture defined in the tail 17 and with which the second end of the spring S is directly or indirectly engaged. The second end S2 of the spring S includes a hook or loop that directly or indirectly engages the anchor/anchor location 19 of the tail. As shown herein, the spring S is a helically coiled tension spring, but other types of springs can be used, and the spring can be combined with a linkage that operably connects the first spring end S1 to the cam lobe 24 and/or connects the second spring end S2 to the anchor 19. In an alternative embodiment, the spring S is arranged as a compression spring that directly or indirectly through a linkage pushes or biases the cam 20 in the second direction FA2 toward the first angular position corresponding to the fully opened position of the appliance lid L. The counterbalance spring S exerts a biasing force F1 on the cam lobe 24 in a first direction such that the cam 20 is urged in the first angular direction FA1 toward its first position corresponding to the appliance lid L being fully opened as shown in FIG. 4A. Accordingly, the biasing force F1 of the counterbalance spring S provides a counterbalance force or effect that assists in movement of the lid L from its closed position toward an opened position as shown in FIG. 4A. On the other hand, movement of the appliance lid L from an opened position toward its closed position causes rotational movement of the cam 20 in the second angular direction FA2 against the biasing force F1 of the counterbalance spring S such that the spring S elongates and tensions and resists such rotational movement of the cam 20 in the second direction FA2 to provide a counterbalance force or effect (or damping force/effect) that resist closing movement of the appliance lid L as shown in FIG. 4C.

A hinge assembly H1 provided in accordance with the present development preferably also includes at least one shock-absorber, damper, or other "snubber" 40 that is connected to and operatively supported by the snubber housing 14. The snubber 40 is contacted by the cam lobe 24 for at least part of the arc on which the cam lobe 24 moves in the second rotational direction FA2 from the first position of the cam 20 (FIG. 4A—corresponding to the fully opened position of the appliance lid L) toward the second position of the cam 20 (FIG. 4C—corresponding to the fully closed position of the appliance lid L) during movement of the appliance lid L from an opened position to the closed position, and the snubber 40 resists but allows movement of the cam lobe 24 in the second direction FA2 when it is contacted by the cam lobe 24 which, in turn, damps movement and prevents slamming of the lid L when it moves from an opened position to the closed position and contacts the appliance body B.

In FIG. 4A, its can be seen that the hinge assembly housing 14 comprises a laterally or horizontally extending snubber installation bore 30. A first end 30*a* of the bore 30 is closed by a bore inner wall or bore end wall 32 or is otherwise partially or fully occluded, and the opposite second end 30*b* of the bore 30 is open and intersects/communicates with the slot 16*s* of the snubber housing 14 in which the cam lobe 24 moves. Alternatively, the housing includes a larger snubber installation bore 30 or multiple parallel snubber installation bores 30, and two or more parallel snubbers 40 are located in the single or multiple installation bore(s) 30, wherein both snubbers 40 are operatively engaged by the cam lobe 24 20 as described herein for the single snubber 40. The snubber 40 is located in the bore 30 and acts as a damper to counteract or attenuate closing force acting on the appliance lid L by gravity and/or as applied to the lid L by a user to prevent or at least resist slamming of the lid L against the body B when the lid moves from an opened position to its closed position and contacts the appliance body B.

Figure 5A:
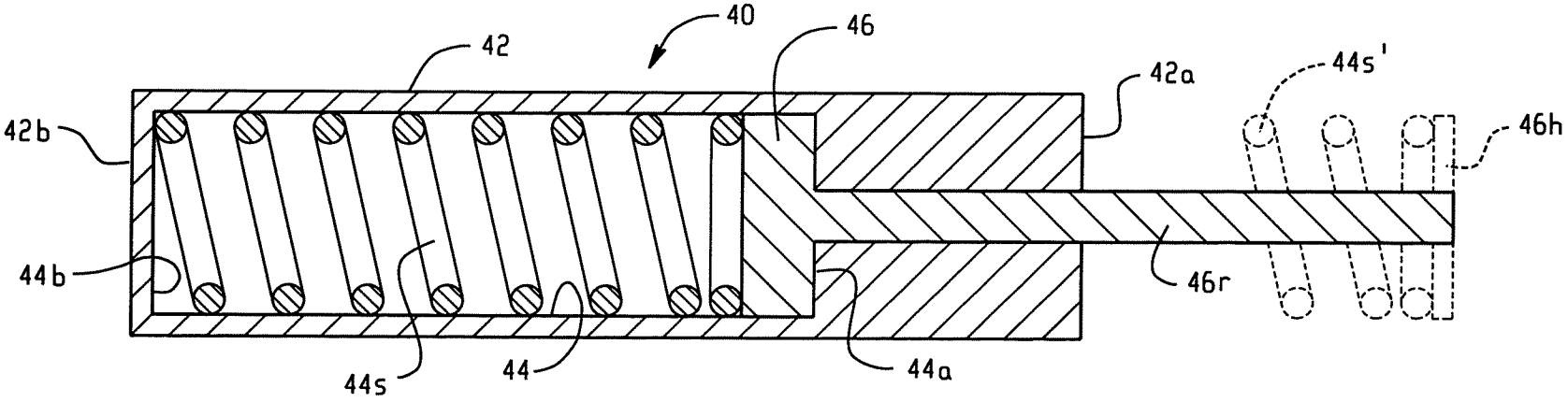
FIGS. 5A and 5B show one example of a suitable snubber used in the hinge assembly of FIG. 3A, which is a self-contained damper cylinder that uses air, oil or another damping fluid and/or that uses a mechanical spring for damping.
Figure 5B:
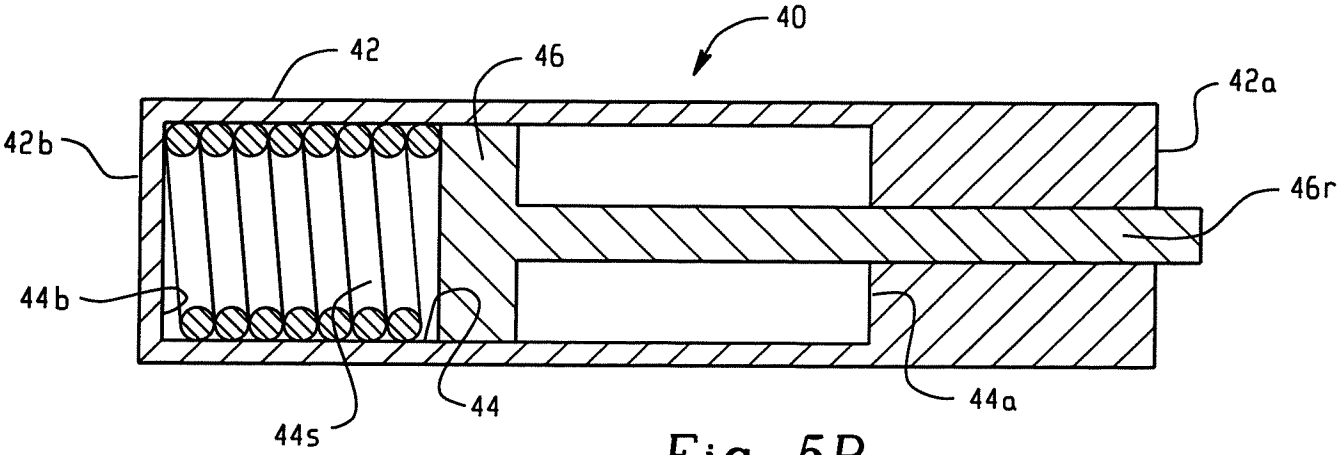

FIGS. 5A and 5B show one example of a suitable snubber 40, which is a self-contained damper cylinder that uses air, oil or another damping fluid and/or that uses a mechanical spring for damping. As shown, the snubber 40 comprises a snubber body 42 including a bore 44 defined therein and in which the damping fluid and/or mechanical damping spring is located. A first end wall 42*a* is connected to or otherwise provided as part of the snubber body 42 and closes a first end 44*a* of the snubber bore 44. A piston 46 is slidably located in the bore 44 and a piston rod 46*r* is connected to and projects outwardly from the piston 46 through the end wall 42*a*. The piston 46 is slidable between an extended position (FIG. 5A) where it is located close to the end wall 42*a* and the piston rod 46*r* extends through and outwardly away from the end wall 42*a* and a retracted position (FIG. 5B) where the piston 46 is moved away from the first end wall 42*a* toward a second end wall 42*b* of the snubber body 42 that is spaced from the first end wall 42*a* and that closes an opposite inner or second end 44*b* of the snubber bore 44 as compared to the first end wall 42*a* and where the piston rod 46*r* is moved or retracted at least partially into the bore 44 (as shown in FIG. 5B) such that the piston rod 46*r* projects outwardly from the first end wall 42*a* to a lesser extent as compared to the extended position or is completely retracted into the bore 44 so that it does not project outwardly from the first end wall 42*a*.

A piston return spring 44*s* (shown in FIGS. 5A and 5B but not shown in FIGS. 4A—4C), such as a coil spring, is operatively located in the bore 44 between the second end wall 42*b* and the piston 46 and urges or biases the piston 46 toward its extended position. In another embodiment, the piston return spring 44*s* is additionally or alternatively provided external relative to the snubber body 42, i.e., located outside the body 42/bore 44 as partially shown in broken lines at 44*s*' and is coaxially positioned about the piston rod 46*r* and operatively engaged between the body 42 and an enlarged head 46*h* or other part of the tip or outer end of the piston rod 46*r*. The oil, air, or other damping fluid is located in the snubber bore 44. Snubber activation force such as inwardly directed axial force exerted on an outermost end of the piston rod 46*r* in a direction toward the second end wall 42*b* and/or an opposite force exerted on the snubber body 42 causes the piston 46 to move toward its retracted position, and the action of the damping fluid on the piston 46 resists or damps such inward movement of the piston 46. The piston 46 includes an orifice or other restricted flow path for the damping fluid to pass through or around the piston to provide resistance to inward movement of the piston. When the snubber activation force or forces acting on the snubber 40 is/are removed, the piston return spring 44*s* urges the piston 46 back to its extended position. Preferably, the piston 46 is configured such that the damping fluid passes through and/or around the piston 46 with less resistance when the piston is moving outward from its retracted position toward its extended position, as compared to when the piston 46 is moving inward from its extended position toward its retracted position. Accordingly, the snubber 40 provides greater damping force during movement of the piston from its extended position toward its retracted position as compared to movement of the piston 46 in the opposite direction, which ensures that the piston 46 will move more quickly and easily from its retracted position to its extended position under force of the return spring 44*s* to reduce the time required for the snubber to reset (the time required for the piston 46 to become fully extended again from its retracted position) after removal of the snubber activation force(s).

The snubber 40 is operatively connected to the housing 14 by insertion of the snubber body 42 into the snubber installation bore 30. In the illustrated embodiment, the snubber body 42 is reciprocally linearly movable relative to the housing 14 in the snubber installation bore 30 on a snubber axis Y that is oriented perpendicularly but offset from the lid pivot axis XL to and between a first (extended) position (FIG. 4A) and a second (retracted) position (FIG. 4C) through in intermediate position (FIG. 4B). In its second position, the snubber body 42 is moved into the snubber installation bore 30 toward the bore inner wall 32, and in its first position, the snubber body 42 is moved outwardly away from the bore inner wall 32 toward the cam lobe 24. As shown, the snubber 40 is oriented with its rod 46*r* directed or pointing into the snubber installation bore 30 toward the bore inner wall 32. The bore inner wall 32 optionally includes a metal disk or other metal reaction member 32*m* (FIG. 4A) positioned in the installation bore 30 between the piston rod 46*r* and the housing 14 to prevent damage to the bore inner wall 32 by the piston rod 46*r*. Optionally, a primary spring 34 such as a coil spring is located in the closed end 30*a* of the snubber installation bore 30 and is abutted with the bore inner wall 32 (as shown partially in FIG. 4A). If included, the primary spring 34 engages the snubber body 42 and urges the snubber body 42 outwardly away from the bore inner wall 32. In one embodiment, the optional primary spring 34 biases the snubber body 42 outwardly toward the cam 20 into continuous abutment or engagement with the cam lobe 24 for all rotational positions of the cam 20 as the cam rotates to and between its first and second operative positions to prevent impact forces being exerted on the second end wall 42*b* of the snubber body 42 by the cam lobe 24 during movement of the cam from its first (lid-opened) position toward its second position as might occur in certain applications if the cam lobe 24 separates from the second end wall 42*b* of the snubber body 42 when the appliance lid L is opened. The optional primary spring 34 is a compression spring that also provides some counterbalance force on the cam 20 via lobe 24 that urges the cam 20 (and lid L engaged therewith) in the first (lid-opening) rotational direction FA1 to provide some assistance to manual opening of the lid L by a user and to provide some additional damping force during closing of the lid L as the cam 20 rotates in the second direction FA2 against the biasing force of the primary spring 34.

In use, as shown in FIGS. 4A-4C, as the cam 20 rotates during movement of the lid L in the second/closing direction FA2 from an opened position toward the closed position, the cam lobe 24 contacts the second end wall 42*b* of the snubber body 42 and urges the snubber body 42 inward on the snubber axis Y toward the bore inner wall 32 such that a snubber activation force is applied to the snubber 40 and the snubber 40 thus exerts an opposite reaction damping force against the rotation of the cam 20 and cam lobe 24 to slow rotation of the cam 20. In particular, the cam lobe 24 urges the snubber body 42 inward from the position shown in FIG. 4A toward the bore inner wall 32 (against the biasing force of the optional primary spring 34 if present) while the piston rod 46*r* is in contact with the end wall 32 as shown in FIG. 4B. Continued movement of the lid L in the closing direction causes the cam lobe 24 to move the snubber body 42 further inward toward the bore inner wall 32 while the piston rod 46*r* is in contact with end wall 32, and this continued inward movement of the snubber body 42 toward the end wall thus causes the piston 46 to move through the damping fluid located in the snubber bore 44 from its extended position (FIG. 4B) to its retracted position (FIG. 4C) such that the snubber 40 resists and damps movement of lid L in the closing direction until the lid L is moved completely to its closed position as shown in FIG. 4C. This rotational movement of the cam 20 in the second direction FA2 will also cause the counterbalance spring S to be tensioned or elongated and the counterbalance force F1 of the spring S will also provide some damping effect or resistance to movement of the appliance lid L toward its closed position.

Upon movement of the lid L in an opposite direction from its closed position toward an opened position, the cam 20 will rotate in the opposite first direction FA1, with the assistance of the counterbalance force F1 applied by the spring S, such that the cam lobe 24 moves away from the bore inner wall 32 which results in removal of the snubber activation force from the snubber 40 which allows the piston return spring 44*s* of the snubber to move the snubber body 42 relative to the piston 46 away from the bore wall 32 to the normal or starting position of the snubber shown in FIG. 4A corresponding to the piston 46 being located in its extended position (FIG. 4A) to reset the snubber 40 so that it is prepared for the next lid-closing event/cycle. The counterbalance force F1 exerted on the cam 20 by the counterbalance spring S reduces the effort required by a user to lift and rotate the lid L from its closed position toward its opened position.

In an alternative embodiment, the orientation of the snubber 40 in the installation bore 30 is reversed such that the piston rod 46*r* projects out of the open end 30*b* of the snubber installation bore 30 and is engaged by the cam lobe 24 when the lid L is moved in the closing direction from an opened position to the closed position. In such case, closing movement of the lid L will cause the cam lobe 24 to push the piston rod 46*r* inwardly toward the second end wall 42*b* of the snubber body 42 so that the piston 46 is urged from its extended position toward its retracted position to provide the required damping effect. In this alternative embodiment, the second end wall 42*b* of the snubber is abutted with the bore inner wall 32 or is engaged with the coil spring or other optional primary spring 34 located in the snubber installation bore 30 between the second end wall 42*b* of the snubber body and the bore inner wall 32.

Figure 6:
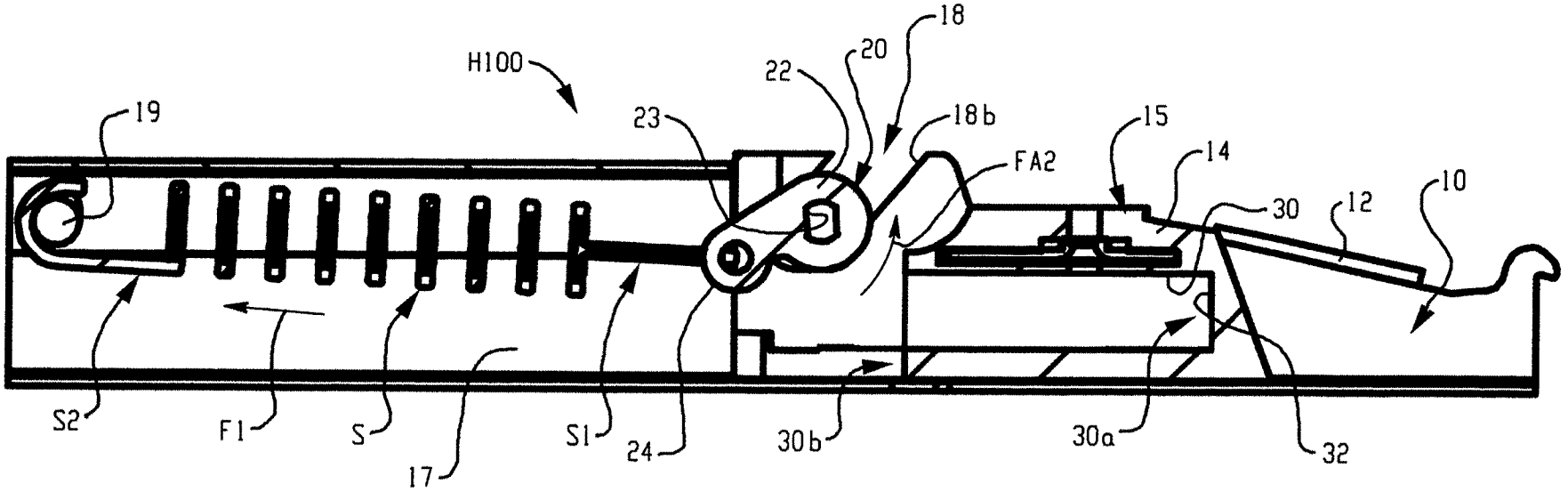
FIG. 6 is a section view similar to FIG. 4A, but shows a hinge assembly provided in accordance with an alternative embodiment wherein the snubber is omitted.

In still another alternative embodiment as shown at H100 in FIG. 6, the snubber 40 is omitted, i.e., the installation bore 30 is left empty or not included in the housing 14, in which case the hinge assembly H1 is a counterbalance hinge assembly only, without any snubber function or effect. The hinge assembly H100 is otherwise structured and functions identically to the hinge assembly H1.

Figure 7:
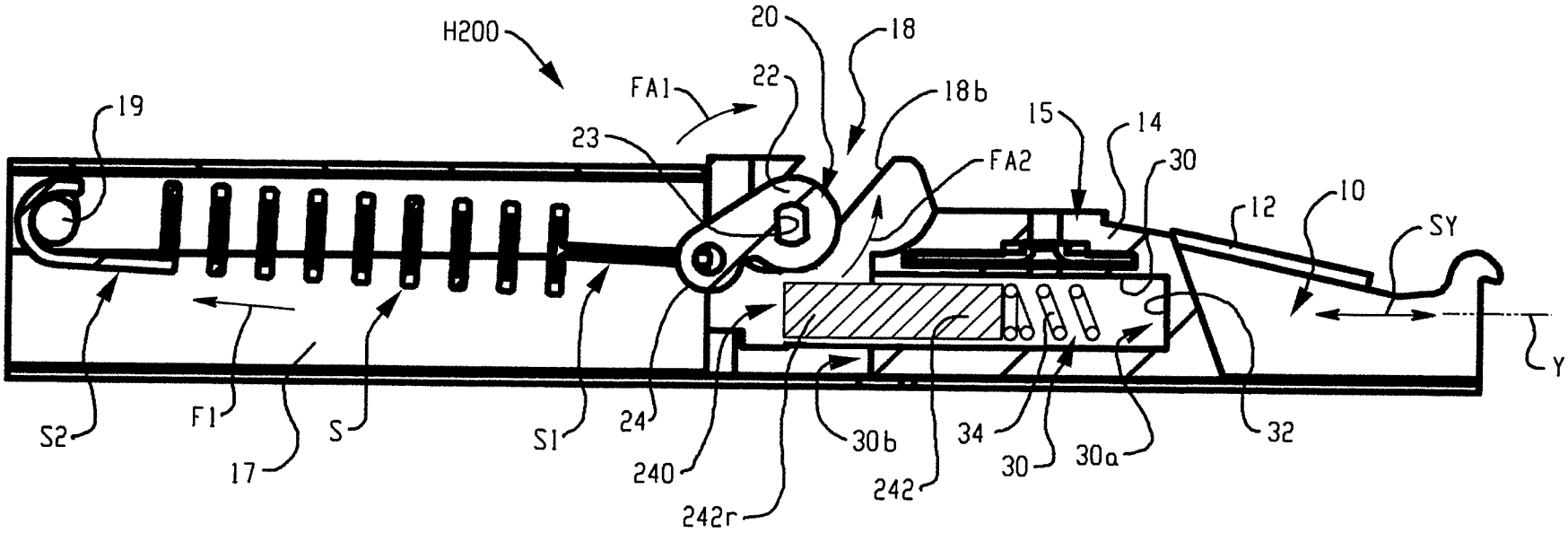
FIG. 7 is a section view similar to FIG. 6, but shows a hinge assembly provided in accordance with another alternative embodiment wherein the snubber is replaced by a rod and a spring to provide a rod-snubber damped hinge assembly.

In a further alternative embodiment as shown at H200 in FIG. 7, a snubber 240 includes a snubber body 242 comprising a snubber rod 242*r* located in the snubber bore 30. A snubber return spring 34 (only partially shown) such as a coil spring is located in the snubber bore 30 between the snubber rod 242*r* and the bore inner wall 32. The snubber rod 242*r* and the snubber return spring 34 provide the snubber of the rod-snubber hinge assembly H200. The snubber rod 142*r* is movable relative to the housing 14 in the snubber bore 30 along the snubber axis Y in a linear reciprocal manner as indicated by the arrow SY between a first (extended) position (as shown in FIG. 7) and a second (retracted) position. In its second (retracted) position, the snubber rod 142*r* is moved into the snubber installation bore 30 toward the bore inner wall 32, and in its first position, the snubber rod 142*r* is moved outwardly away from the bore inner wall 32 toward the cam lobe 24. In this embodiment, the cam lobe 24 engages the outer end snubber rod 142*r* and exerts a snubber activation force on the snubber rod 142*r* when the cam rotates in the second direction FA2 in response to movement of the lid L in the closing direction from an opened position toward the closed position and moves the snubber rod 142*r* inwardly on the snubber axis Y from its first position (shown in FIG. 7) toward the bore inner wall 32 to its second position against the biasing force of the snubber return spring 34 such that the snubber return spring 34 resists and damps movement of the lid L in the closing direction. The snubber return spring 34 also provides some additional counterbalance force to urge the snubber rod 142*r* outwardly toward its first position away from the bore inner wall 32 and urges the cam lobe 24 in its first rotational direction FA1 to assist in movement of the lid L in the opening direction toward the opened position. The hinge assembly H200 is otherwise structured and functions identically to the hinge assembly H1.

In one embodiment of the appliance A, only the first hinge assembly H1 is provided in accordance with the hinge assembly H1 disclosed herein, while the second hinge assembly H2 is provided by a different hinge assembly such as the hinge assembly H100 shown in FIG. 6, the hinge assembly H200 shown in FIG. 7, or another hinge assembly. In another embodiment, the hinge assembly H1 for the appliance is provided as described herein, and the hinge assembly H2 is identically structured to the hinge assembly H1, but is provided as a mirror image to the hinge assembly H1 or by an ambidextrous version of the hinge assembly H1. In still another alternative embodiment, both the first and second hinge assemblies H1,H2 are provided as a hinge assembly H100, i.e., as a counterbalance spring hinge assembly H100 without the snubber as is shown in FIG. 6 or by a mirror image or ambidextrous version of the hinge assembly H100. In still a further alternative embodiment, both the first and second hinge assemblies H1,H2 are provided as a hinge assembly H200.

The present development has been described with reference to preferred embodiments. Modifications and alterations will occur to those of ordinary skill in the art to which the present development pertains, and it is intended that the claims be construed as broadly as possible to encompass all such modifications and alterations while preserving the validity of the claims.

The invention claimed is:

1. A hinge assembly for pivotally connecting an associated appliance lid to an associated appliance body, said hinge assembly comprising:

a metal base adapted to be connected to the associated appliance body, said base comprising a projecting tail;

a one-piece polymeric snubber housing connected to the base, said snubber housing comprising a snubber installation bore, wherein a first end of said snubber installation bore is at least partially closed by an inner wall;

a cam rotatably supported on the snubber housing, said cam adapted to be operably connected to the associated appliance lid and rotatable about a lid pivot axis in a first direction and in a second direction that is opposite the first direction, said cam comprising a camshaft supported for rotation about said lid pivot axis in said first and second directions and comprising a lobe that projects outwardly from the camshaft and that rotates with the camshaft about the lid pivot axis;

a snubber slidably engaged with the snubber housing, said snubber comprising: (i) a snubber body including a bore defined therein and including first and second end walls located at opposite ends of the snubber body bore; (ii) a piston slidably located in the snubber body bore between the first and second end walls; (iii) a piston rod connected to the piston and projecting outwardly from the piston through the first end wall of the snubber body; (iv) a piston return spring that urges the piston toward the first end wall; and, (v) a damping fluid located in said snubber body bore and acting on said piston;

said piston slidable in said snubber body bore to and between an extended position and a retracted position, wherein said piston is located closer to said first end wall of said snubber body and said piston rod projects outwardly away from the first end wall of the snubber body to a greater extent when said piston is located in said extended position as compared to when said piston is located in said retracted position;

said snubber body positioned in said snubber installation bore of said base and adapted for reciprocal linear sliding movement in said snubber installation bore;

wherein the lobe of the cam moves on an arc relative to the base and the snubber housing about the lid pivot axis and said lobe of said cam is in contact with said second end wall of said snubber body and exerts a snubber activation force on said snubber when said camshaft rotates about said lid pivot axis in the second direction corresponding to movement of the associated appliance lid from an opened position toward a closed position and such that said snubber body is moved slidably in said snubber installation bore toward said inner wall of said snubber installation bore and such that said piston moves from said extended position toward said retracted position through said damping fluid whereby said snubber damps movement of said cam when said camshaft rotates in said second direction, said piston return spring urging said piston toward its extended position to reset the snubber when the snubber activation force is removed from said snubber;

a counterbalance spring comprising a coiled tension spring operatively engaged between said projecting tail of said base and said cam and exerting a tension counterbalance force on said cam that biases said cam in said first direction corresponding to movement of the associated appliance lid from said closed position toward said opened position.

2. The hinge assembly as set forth in claim 1, wherein the piston is configured such that the damping fluid passes by the piston with less resistance when the piston is moving from its retracted position toward its extended position as compared to when the piston is moving from its extended position toward its retracted position such that said snubber provides greater damping force during movement of the piston from its extended position toward its retracted position as compared to movement of the piston from its retracted position toward its extended position.

3. The hinge assembly as set forth in claim 1, further comprising a primary spring operatively positioned in said snubber installation bore between said inner wall of said snubber installation bore and said snubber body and biasing said snubber body away from said inner wall toward a first position, said snubber body selectively moveable by said snubber activation force into said bore toward a second position against said biasing of said primary spring.

4. The hinge assembly as set forth in claim 3, wherein said primary spring biases said snubber body outwardly away from said inner wall such that said second end wall of said snubber body is in continuous abutment with the cam lobe for all operative positions of said cam.

5. The hinge assembly as set forth in claim 1, wherein said piston return spring is operatively located in the snubber body bore between the second end wall and the piston.

6. The hinge assembly as set forth in claim 1, wherein said piston return spring is located external relative to said snubber body and is operatively located between the snubber body and an outer end of said piston rod.

7. The hinge assembly as set forth in claim 1, wherein said hinge assembly is operatively connected to an appliance, said appliance comprising:

an appliance body including a chamber with an open mouth; and a lid for selectively covering the open mouth of the chamber;

wherein said base of said hinge assembly is connected to said appliance body and said lid is connected to said cam such that said hinge assembly pivotally connects the lid to the appliance body for movement of the lid between opened and closed positions relative to said chamber of said appliance body.

* * * * *